US006389780B1

(12) United States Patent
Coomber et al.

(10) Patent No.: US 6,389,780 B1
(45) Date of Patent: May 21, 2002

(54) ZIPPER BAG FORM, FILL AND SEAL MACHINE AND METHOD

(75) Inventors: Thomas L. Coomber, Palmyra; Alexander R. Provan, Canandaigua; Toby R. Thomas, Victor, all of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/636,471

(22) Filed: Aug. 10, 2000

(51) Int. Cl.[7] ..... B65B 61/18
(52) U.S. Cl. ..... 53/412; 53/133.4; 53/139.2
(58) Field of Search ..... 53/133.4, 139.2, 53/412, 450, 550; 156/66; 493/214

(56) References Cited

U.S. PATENT DOCUMENTS

| | | | | |
|---|---|---|---|---|
| 3,381,592 | A | 5/1968 | Ravel | |
| 3,473,589 | A | 10/1969 | Gotz | |
| 3,532,571 | A | 10/1970 | Ausnit | |
| RE27,174 | E | 9/1971 | Ausnit | |
| 3,608,439 | A | 9/1971 | Ausnit | |
| 3,613,524 | A | 10/1971 | Behr et al. | |
| 3,701,191 | A | 10/1972 | Laguerrre | |
| 3,701,192 | A | 10/1972 | Laguerre | |
| 3,785,111 | A | 1/1974 | Pike | |
| 3,839,128 | A | 10/1974 | Arai | |
| 3,948,705 | A | 4/1976 | Ausnit | |
| 3,988,184 | A | * 10/1976 | Howard | 156/66 |
| 4,094,729 | A | 6/1978 | Boccia | |
| 4,196,030 | A | 4/1980 | Ausnit | |
| 4,240,241 | A | 12/1980 | Sanborn, Jr. | |
| 4,246,288 | A | 1/1981 | Sanborn, Jr. | |
| 4,277,241 | A | 7/1981 | Schulze | |
| 4,341,575 | A | 7/1982 | Herz | |
| 4,355,494 | A | 10/1982 | Tilman | |
| 4,372,793 | A | 2/1983 | Herz | |
| 4,415,386 | A | 11/1983 | Ferrell et al. | |
| 4,430,070 | A | 2/1984 | Ausnit | |
| 4,437,293 | A | 3/1984 | Sanborn, Jr. | |
| 4,517,788 | A | 5/1985 | Scheffers | |
| 4,528,224 | A | 7/1985 | Ausnit | |
| 4,563,319 | A | 1/1986 | Ausnit et al. | |
| 4,581,006 | A | 4/1986 | Hugues et al. | |
| 4,582,549 | A | 4/1986 | Ferrell | |
| 4,601,694 | A | 7/1986 | Ausnit | |
| 4,617,683 | A | 10/1986 | Christoff | |
| 4,651,504 | A | 3/1987 | Bentsen | |
| 4,655,862 | A | 4/1987 | Christoff et al. | |
| 4,663,915 | A | 5/1987 | Van Erden et al. | |
| 4,666,536 | A | 5/1987 | Van Erden et al. | |
| 4,673,383 | A | 6/1987 | Bentsen | |
| 4,691,372 | A | 9/1987 | Van Erden | |
| 4,703,518 | A | 10/1987 | Ausnit | |

(List continued on next page.)

FOREIGN PATENT DOCUMENTS

| | | |
|---|---|---|
| EP | 0 939 034 | 9/1999 |
| EP | 0 978 450 | 2/2000 |
| EP | 1 026 077 A2 | 8/2000 |
| GB | 2 085 519 | 4/1982 |
| WO | 99/24325 | 5/1999 |

*Primary Examiner*—John Sipos
(74) *Attorney, Agent, or Firm*—Jenkens & Gilchrist

(57) ABSTRACT

A machine and method for forming, filling and sealing bags includes a slitter for slitting a web of film into first and second web portions. a first folding board is included for folding the first web portion to a vertical position. a zipper track is fed adjacent to and sealed to the vertical first web portion by a first zipper sealer. a second folding board folds the second web portion to a position adjacent the first web portion and the zipper track is sealed to the second web portion by a second zipper sealer. another sealer forms side seals in the first and second web portions and the web portions are cut along the side seals to form individual bags.

13 Claims, 2 Drawing Sheets

U.S. PATENT DOCUMENTS 4,709,398 A 11/1987 Ausnit
4,709,533 A 12/1987 Ausnit
4,710,157 A 12/1987 Posey
4,782,951 A 11/1988 Griesbach et al.
4,787,880 A 11/1988 Ausnit
4,790,126 A 12/1988 Boeckmann
4,807,300 A 2/1989 Ausnit et al.
4,812,074 A 3/1989 Ausnit et al.
4,840,012 A 6/1989 Boeckmann
4,840,611 A 6/1989 Van Erden et al.
4,844,759 A 7/1989 Boeckmann
4,850,178 A 7/1989 Ausnit
4,876,842 A 10/1989 Ausnit
4,878,987 A 11/1989 Ven Erden
4,892,414 A 1/1990 Ausnit
4,892,512 A 1/1990 Branson
4,924,655 A 5/1990 Posey
4,925,318 A 5/1990 Sorensen
4,929,225 A 5/1990 Ausnit et al.
4,941,307 A 7/1990 Wojcik
4,969,309 A 11/1990 Schwarz et al.
4,974,395 A 12/1990 McMahon
4,993,212 A 2/1991 Veoukas
5,005,707 A 4/1991 Hustad et al.
5,014,498 A 5/1991 McMahon
5,027,584 A 7/1991 McMahon et al.
5,036,643 A 8/1991 Bodolay
5,042,224 A 8/1991 McMahon
5,046,300 A 9/1991 Custer et al.
5,063,639 A 11/1991 Boeckmann et al.
5,072,571 A 12/1991 Boeckmann
5,085,031 A 2/1992 McDonald
5,092,831 A 3/1992 James et al.
5,096,516 A 3/1992 McDonald et al.
5,105,603 A 4/1992 Natterer
5,107,658 A 4/1992 Hustad et al.
5,111,643 A 5/1992 Hobock
5,116,301 A 5/1992 Robinson et al.
5,127,208 A 7/1992 Custer et al.
5,147,272 A 9/1992 Richison et al.
5,179,816 A 1/1993 Wojnicki
5,188,461 A 2/1993 Sorensen
5,211,482 A 5/1993 Tilman
5,247,781 A 9/1993 Runge
5,254,073 A 10/1993 Richison et al.
5,259,904 A 11/1993 Ausnit
5,273,511 A 12/1993 Boeckmann
5,322,579 A 6/1994 Van Erden
5,334,127 A 8/1994 Bruno et al.
5,383,989 A 1/1995 McMahon
5,400,565 A 3/1995 Terminella et al.
5,400,568 A 3/1995 Kanemitsu et al.
5,405,629 A 4/1995 Marnocha et al.
5,412,924 A 5/1995 Ausnit
5,415,904 A 5/1995 Takubo et al.
5,425,216 A 6/1995 Ausnit
5,425,825 A 6/1995 Rasko et al.
5,435,864 A 7/1995 Machacek et al.
5,470,156 A 11/1995 May
5,489,252 A 2/1996 May
5,492,411 A 2/1996 May
5,505,037 A 4/1996 Terminella et al.
5,509,735 A 4/1996 May
5,511,884 A 4/1996 Bruno et al.
5,519,982 A 5/1996 Herber et al.
5,525,363 A 6/1996 Herber et al.
5,542,902 A 8/1996 Richison et al.
5,551,127 A 9/1996 May
5,551,208 A 9/1996 Van Erden
5,557,907 A 9/1996 Malin et al.
5,558,613 A 9/1996 Tilman et al.
5,561,966 A 10/1996 English
5,564,259 A 10/1996 Stolmeier
5,573,614 A 11/1996 Tilman et al.
B24,894,975 A 11/1996 Ausnit
5,592,802 A 1/1997 Malin et al.
5,613,934 A 3/1997 May
5,628,566 A 5/1997 Schreiter
5,647,671 A 7/1997 May
5,669,715 A 9/1997 Dobreski et al.
5,682,730 A 11/1997 Dobreski
5,725,312 A 3/1998 May
5,782,733 A 7/1998 Yeager
5,788,378 A 8/1998 Thomas
5,823,933 A 10/1998 Yeager
5,833,791 A 11/1998 Bryniarski et al.
B14,909,017 A 2/1999 McMahon et al.
5,906,438 A 5/1999 Laudenberg
5,938,337 A 8/1999 Provan et al. ..... 383/5
5,956,924 A 9/1999 Thieman
6,044,621 A 4/2000 Malin et al.
6,138,436 A 10/2000 Malin et al.
6,138,439 A 10/2000 McMahon et al.
6,185,907 B1 2/2001 Malin et al. ..... 53/412

* cited by examiner

ZIPPER BAG FORM, FILL AND SEAL MACHINE AND METHOD

FIELD OF THE INVENTION

The present invention generally relates to machines for forming, filling and sealing plastic bags and, more particularly, to horizontal form, fill and seal machines for zipper bags and to a method for forming, filling and sealing zipper bags.

BACKGROUND OF THE INVENTION

Plastic bags with reclosable zippers of the type closed by finger pressure are commonly formed on vertical and horizontal form, fill and seal machines. Vertical form, fill and seal machines typically wrap film around a tube. Seals are made in the film to form a bag and product is dropped through the tube into the bag. Overwrap form, fill and seal machines typically wrap film around a product and seal the film to form a bag. Horizontal form, fill and seal machines generally fold film, transverse seal into a three sided package, drop product into the package, and seal the package closed.

Early form, fill and seal machines wrapped film around a product or dropped a product into an envelope and the film was sealed on all sides of the product. Once these bags were opened, they could not be reclosed and other containers were used to store left over product. Many products purchased today are packaged with these early form, fill and seal methods. To meet a need for reclosable bags, zippers that could be closed by finger pressure were developed. New form, fill and seal machines were developed to form and fill these bags.

Recently, reclosable zippers with sliders that open and close the zippers have been developed. To form and fill bags with the slider zippers requires mounting sliders onto zippers, securing the zippers to bag film, forming a bag from the film, and filling the bag with product. It is desirable to perform all of these steps continuously in order to maximize efficiency and minimize the cost of the bags.

SUMMARY OF THE INVENTION

The present invention provides a product filled bag that is reclosable by a zipper. The zipper is opened and closed by a slider mounted on the zipper. The bag is made and filled by a form, fill and seal machine that starts by slitting a web of film into a first web portion and a second web portion. The first web portion is folded by a folding board to a position approximately vertical or perpendicular to the second web portion. In this position, the first web portion is accessible for securement of one track of a zipper. A continuous zipper with sliders mounted on it at predetermined intervals is fed to a sealer which seals one track of the zipper to the first web portion. Thereafter, another folding board folds the second web portion adjacent to and parallel with the first web portion. A second track of the zipper is sealed to the second web portion. Side seals are then formed in the web portion and are cut to form individual bags. Product can be filled into the bags before or after the cutting.

BRIEF DESCRIPTION OF THE DRAWINGS

Other objects and advantages of the invention will become apparent upon reading the following detailed description and upon reference to the drawings in which.

DETAILED DESCRIPTION OF THE PREFERRED EMBODIMENTS

Figure 1:
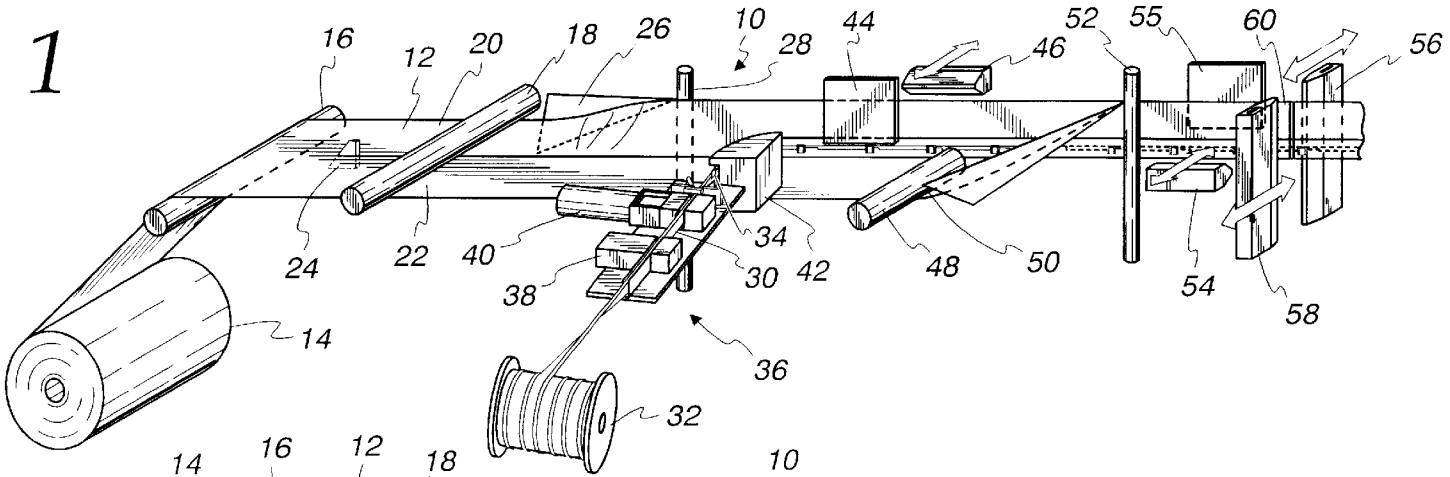
FIG. 1 is a schematic illustration of a form, fill and seal machine constructed in accordance with the principles of the present invention.
Figure 2:
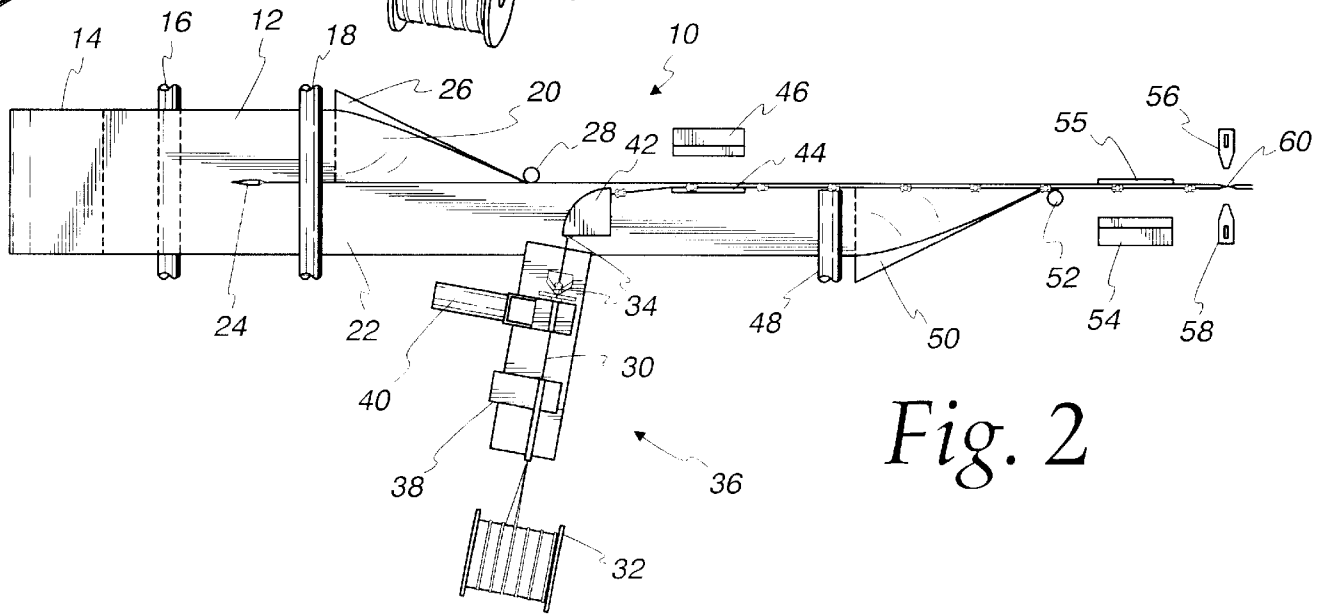
FIG. 2 is a plan view of the schematic illustration of FIG. 1.

Referring initially to FIGS. 1 and 2, there is schematically illustrated a form, fill and seal machine generally designated by the reference number 10. The machine 10 is a horizontal form, fill and seal machine, but the principles of this invention are also applicable to other machines such as a vertical form, fill and seal machine. The purpose of the machine 10 is to make bags with reclosable zippers out of film and then fill these bags with product. To this end, a web of plastic packaging film 12 is supplied in a continuous stream to the machine 10 from a roll of film 14. The web of film 12 is guided by a web guiding mechanism schematically illustrated by a pair of rollers 16 and 18. The web guiding mechanism maintains the alignment position of the web 12 as the web 12 is fed into the machine 10.

The machine 10 includes a component for cutting the web 12 into a first web portion 20 and a second web portion 22 which eventually will be formed into the sides of a bag. In the embodiment illustrated, the cutting component is a slitter blade 24. In a preferred embodiment, the slitter blade 24 is in alignment with the centerline of the machine 10 such that the first and second web portions 20 and 22 are of equal size and configuration.

Downstream of the slitter blade 24, the first web portion 20 is folded or turned to a vertical orientation relative to the second web portion 22 by a first folding plow or board 26 and a first vertical guide bar 28. In this configuration, the first web portion 20 is accessible for attachment of a reclosable zipper 30. Reclosable zipper 30 is supplied to the machine 10 from a reel 32. The zipper 30 is of the type that includes a male track with a male profile and a depending fin and a female track with a female profile and a depending fin. An example of this zipper is provided in U.S. Pat. No. 5,007,143.

In the preferred embodiment, the zipper 30 is opened and closed by a slider 34. Sliders 34 are mounted on the zipper 30 by a punch and inserter assembly 36. The punch and inserter assembly 36 includes a punch 38 to remove sections of the zipper 30. Each time the web of plastic packaging film 12 is advanced or indexed, the punch 38 is activated to remove a section of the zipper 30. This occurs during the dwell in the machine 10 when sealing, cutting and other operations necessary for bag making are being performed. This section or notch should be in the portion of the zipper 30 that is at a side seal between adjacent bags. Additional details concerning this technique may be obtained from U.S. Pat. No. 5,431,760 and U.S. patent application Ser. No. 09/534,404 entitled "Apparatus And Method For Inserting A Slider Onto A Fastener" filed Mar. 22, 2000 assigned to the assignee of the present invention and incorporated herein by reference. The purpose of this section or notch is to provide a place where a slider 34 can be placed in alignment with the zipper track profile. This placement of the sliders 34 is performed by a slider inserter 40. The slider inserter 40 is located about one bag width downstream from the punch 38, and its location can be adjusted to accommodate different size bags. Further details concerning this technique of inserting a slider onto a notched zipper may be obtained from U.S. patent application Ser. No. 09/307,937 to Proven et al., entitled "Zipper and Zipper Arrangements and Methods of Manufacturing the Same," filed May 10, 1999, and incorporated herein by reference. Alternatively, the guide 42 can be positioned to direct the zipper 30 with sliders 34 to extend along the upper end of the first web portion 20. The first embodiment results in a bottom fill bag and the alternative embodiment results in a top fill bag.

The zipper 30 with sliders 34 is directed by a guide 42 to extend along the lower end of the first web portion 20 to a location between the first web portion 20 and a backing plate 44. A reciprocating sealer 46 such as a heated sealing bar is in the same location on the opposite side of the first web portion 20 from the zipper 30. During the dwell in the machine 10, the heated sealing bar 46 is reciprocated to seal the first web portion 20 to a portion of the zipper 30.

Up to this point in the machine 10, the second web portion 22 has traveled in a horizontal path. Downstream of the heating sealing bar 46, however, the second web portion 22 passes under a roller 48 and along a second folding plow or board 50 and a second vertical guide 52 which fold the second web portion 22 to a vertical orientation causing the inside surfaces of the first web portion 20 and the second web portion 22 to be brought together. The paths taken by each web portion 20 and 22 up to this point are similar so that no alignment structure is required to register the front and back panels of the bags. The aligned first and second web portions 20 and 22 are then indexed downstream to a second reciprocating sealing bar 54 which seals the second web portion 22 to a portion of the zipper 30 against backing plate 55.

The first and second web portions 20 and 22 with the zipper sealed to the portions 20 and 22 are indexed to a location between side sealing bars 56 and 58 that are reciprocated to engage the web portions 20 and 22 and form side seals 60.

Figure 3:
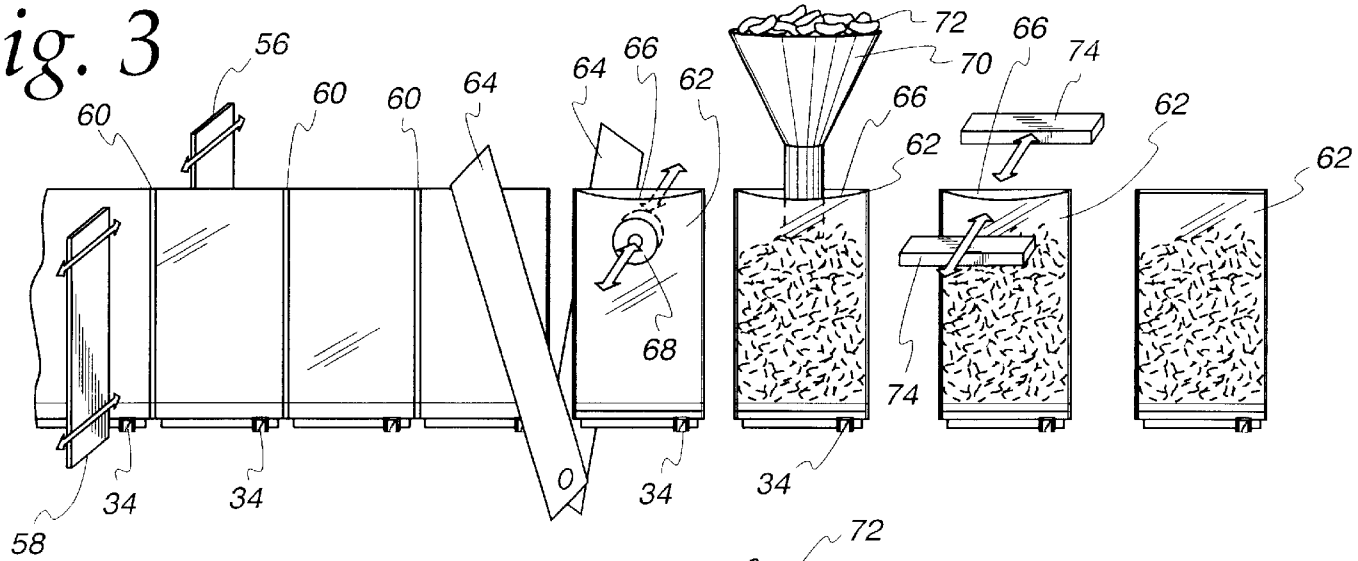
FIG. 3 is a schematic illustration of a side sealing, bag cutting and bag filling assembly that is part of the machine schematically illustrated in FIGS. 1 and 2.
Figure 4:
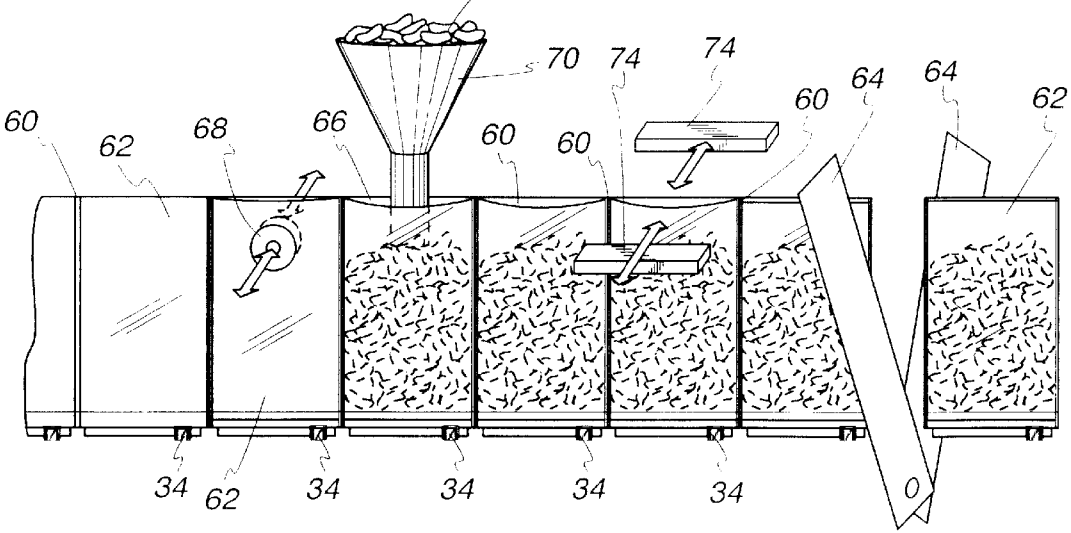
FIG. 4 is an alternative embodiment of the assembly illustrated in FIG. 3.

Following the formation of the side seals 60, the web portions 20 and 22 with the zipper 30 are advanced to a cutting and filling portion of the machine 10 (FIGS. 3 and 4). In one embodiment of the cutting and filling portion of the machine 10 (FIG. 3), individual bags 62 are formed by cutting the side seals 60 approximately in half with cutting blades 64 or other cutting devices. An unsealed end 66 of each bag is then pulled open by vacuum devices 68 or similar devices and moved under a filling spout 70 which drops product 72 into each bag 62. Each filled bag 62 is then indexed to heated bag end sealing bars 74 which engage and seal the end 66 of each bag 62.

Alternatively, each unsealed end 66 of each bag is first opened by the vacuum devices 68, filled with product 72, and sealed by the sealing bars 74 (FIG. 4). The bags 62 are then separated by the cutting blades 64.

The entire paths of each web portion 20 and 22 are identical in length so that the original edges of the web 12, prior to cutting by blades 64, are brought back together at the end of the machine 10. This ensures that any graphics printed on the web of film 12 will maintain their alignment throughout the length of the roll 14 and there will not be a misalignment of the graphics on the front and rear panels of each finished bag 62.

It is also contemplated that gussets on the top or bottom of the bags can be provided. These bags can be filled through the gusset or between the web and zipper.

While the present invention has been described with reference to one or more particular embodiments, those skilled in the art will recognize that many changes may be made thereto, without departing from the spirit and scope of the present invention. Each of these embodiments and obvious variations thereof, is contemplated as falling within the spirit and scope of the claimed invention, which is set forth in the following claims.

What is claimed is:

1. A method of forming bags with closures, comprising: slitting a web of film into a first portion orienting said first portion of said web at an angle relative to said second portion of said web, and a second portion, positioning a closure adjacent said first portion of said web, and securing said closure to said first portion, orienting said second portion of said web relative to said first portion of said web to a location adjacent to said closure and said first portion of said web, sealing said closure to said second portion of said web, and sealing and cutting said first and second portions of said web to form sides and an open end of a bag.

2. The method claimed in claim 1 further comprising filling each said bag and sealing said open end.

3. The method claimed in claim 1 wherein said positioning said closure includes placing a slider on said closure.

4. The method of forming bags claimed in claim 1 further comprising:

cutting and sealing said first and second portions of said web and said track material to form bags.

5. A method of forming bags with closures comprising:

slitting a continuous web of film into a first portion and a second portion, orienting said first portion of said web to an orientation that is at an angle to said second portion of said web such that said first portion is readily accessible, placing a closure adjacent said first portion of said web, sealing said closure to said first portion of said web, orienting said second portion of said web to a position adjacent said first portion of said web, sealing said closure to said second portion of said web, and sealing and cutting said first and second portions of said web to form individual bags.

6. A method of forming bags with zipper closures on a horizontal form, fill and seal machine comprising:

feeding a web of film to a horizontal form, fill and seal machine;

slitting said web of film into a first portion and a second portion, orienting and guiding said first portion of said web to a position approximately perpendicular to said second portion of said web, providing a supply of zipper track material, removing sections of said track material at predetermined locations along said track material, inserting sliders onto said track material at the removed sections of said track material, attaching said track material to said first portion of said web, orienting and guiding said second portion of said web to a position adjacent to and approximately parallel with said first portion of said web, and attaching said track material to said second portion of said web.

7. An apparatus for forming bags with a zipper closure, comprising:

a web slitter for cutting a web of film into first and second portions, a first orienting member for orienting said first portion of said web at an angle relative to said second portion, a source of zipper track, a first attachment mechanism for attaching said zipper track to said oriented first portion of said web, a second orienting member for orienting said second portion of said web to a position adjacent to and parallel with said first portion of said web, and a sealing and cutting mechanism for forming separate bags and side seals in said separate bags.

8. The apparatus claimed in claim 7 wherein said source of zipper track includes a punch for removing a section of said zipper track to form a notch in said track material, and an inserter for inserting a slider onto said zipper track at said notch.

9. The apparatus claimed in claim 7 wherein said second orienting member is spaced downstream from said first orienting member.

10. The apparatus claimed in claim 7 further comprising a second attachment mechanism for attaching said zipper track to said second portion of said web.

11. A horizontal form, fill and seal machine for forming and filling bags, comprising:

a slitter for slitting a web of film into a first horizontal web portion and a second horizontal web portion, a first orienting board downstream of said slitter for orienting said first web portion to a vertical orientation relative to said second web portion, a first zipper sealer downstream of said first folding board for sealing at least a portion of a zipper to said first web portion, a second orienting board downstream of said first zipper sealer for orienting said second web portion to a vertical orientation adjacent and parallel to said first web portion, a side sealer and cutter for forming side seals in said first and second web portions and cutting said first and second web portions to form individual bags.

12. The horizontal form, fill and seal machine claimed in claim 11 further comprising a second zipper sealer downstream of said second orienting board for sealing at least a portion of said zipper to said second web portion.

13. The horizontal form, fill and seal machine claimed in claim 11 further comprising zipper track material, a punch for removing a section of said zipper track material at predetermined locations, and an inserter for inserting sliders at said predetermined locations.

* * * * *